United States Patent [19]

Jones et al.

[11] 3,994,788

[45] Nov. 30, 1976

[54] ELECTROCHEMICAL OXIDATION OF PHENOL

[75] Inventors: Glenn C. Jones; Dewitt A. Payne, both of Kingsport, Tenn.

[73] Assignee: Eastman Kodak Company, Rochester, N.Y.

[22] Filed: Dec. 5, 1975

[21] Appl. No.: 638,202

[52] U.S. Cl. ..... 204/78

[51] Int. Cl.[2] ..... C25B 3/02

[58] Field of Search ..... 204/78

[56] References Cited

UNITED STATES PATENTS 3,873,580 3/1975 Rennie ..... 204/78

3,951,774 4/1976 Jones ..... 204/78

*Primary Examiner*—R. L. Andrews

*Attorney, Agent, or Firm*—J. Frederick Thomsen; Daniel B. Reece, III

[57] ABSTRACT

In the electrochemical oxidation of phenol the concentration of p-benzoquinone is maintained at a low level and the formation of tars is substantially retarded by the continuous or intermittent addition of copper to the electrolytic cell.

4 Claims, No Drawings

ELECTROCHEMICAL OXIDATION OF PHENOL

This invention relates to a process for manufacturing hydroquinone and catechol by the electrochemical oxidation of phenol, and more particularly, to an improvement in the process which comprises the addition of copper to the electrochemical cell during the oxidation.

The electrochemical oxidation of phenol to p-benzoquinone, hydroquinone, and a complex mixture of by-products, is well known as is shown by U.S. Pat. Nos. 2,135,368; 3,509,031; 3,616,324, and 3,663,381. According to these patents, a wide variety of electrode materials and process conditions can be employed in the electrochemical oxidation in which phenol is converted at the anode to p-benzoquinone which then is reduced to hydroquinone at the cathode.

Many variables are involved in electrochemical reactions and, in particular, in organic electrochemical oxidations. It is difficult to control all of these variables to render an electrochemical process commercially feasible when compared to other non-electrochemical synthesis techniques. It is apparent that for production of hydroquinone by the electrochemical oxidation of phenol to be commercially, i.e. economically, feasible, the combination of both operating and capital costs must be favorable. Variables affecting these costs include cell configuration, choice of electrode material, electrode potential, current density. temperature, electrolyte composition, phenol concentration, time of reaction, percent conversion and the like. It is well known that the economic viability of a chemical process is dependent on the amount of saleable product or products obtained over a given period of time per dollar invested in plant equipment. To increase the hydroquinone production rate, the electrochemical oxidation must be carried out at high current densities and high current efficiencies. Thus, U.S. Pat. No. 3,509,031 teaches that it is preferred to electrochemically oxidize phenol to hydroquinone at an anode current density of 20 to 100 amperes per square decimeter ($A/dm^2$) at a lead dioxide-on-lead anode wherein the lead dioxide surface is generated in situ. It has been found, however, that when phenol is oxidized at such an anode at a current density of 20 to 100 $A/dm^2$ the current efficiency for conversion of phenol to saleable products is commercially unacceptable. It also has been found that the presence of iron in the phenol-electrolyte solution lowers the current efficiency and chemical yield obtained by using a lead dioxide-on-lead anode. Avoiding the presence of iron in the operation of a commercial plant would be both difficult and expensive.

Phenol can be electrochemically oxidized to hydroquinone and co-product catechol at excellent conversion rates and at good current efficiencies and chemical yields by using certain cell conditions and a solid anode having a surface of electrodeposited lead dioxide. The oxidation of phenol at an electrodeposited lead dioxide anode, as opposed to lead dioxide conventionally formed in situ, for example by forming lead sulfate on a lead anode and further oxidizing it to lead dioxide, is a substantial improvement over the methods described in the patents referred to above. One advantage derived from the use of an electrodeposited lead dioxide anode is that good current efficiencies are obtained under operating conditions which give relatively high conversion rates of phenol to hydroquinone. Such efficiencies are realized even when the electrolyte solution contains significant concentrations of hydroquinone and quinone.

Another advantage realized from the use of electrodeposited lead dioxide rather than lead dioxide formed in situ is that the presence of iron in the reaction mixture does not adversely affect current efficiency as it does with the use of lead dioxide formed in situ. As mentioned hereinabove, it is very difficult, and practically commercially prohibitive, to construct a plant so as to eliminate the presence of trace amounts of iron which contaminate the reaction mixture. A further advantage is that the use of an electrodeposited lead dioxide anode gives increased yields of and higher current efficiencies for catechol in addition to increased production rates of hydroquinone.

The higher electrical efficiency at high rates of conversion of phenol to hydroquinone and catechol obtained by using electrodeposited lead dioxide anodes results in a lower cost per pound of saleable products produced in the process. Use of such an anode also allows one to economically achieve higher hydroquinone concentrations in the product stream, thus reducing the capital requirements for a plant, i.e., product recovery is more economical due to the higher concentration of product in the cell effluent.

We have found that during the electrochemical oxidation of phenol using an electrodeposited lead dioxide anode, over extended periods of operation tars form and deposit on the cathode surface, causing cell voltage to increase and the current efficiency and chemical yield to decrease. The tars are believed to be caused primarily by the oligomerization and polymerization of p-benzoquinone and by its reaction with the phenolic compounds present. During the oxidation, tars continue to deposit on the cathode surface until operation of the cell becomes economically unattractive due to low current efficiency and chemical yield. The oxidation then must be discontinued and the cell cleaned. As used herein, the term current efficiency in percent is calculated as follows: Current Efficiency $= (100\, n\, F)/It$ (moles hydroquinone + moles p-benzoquinone) wherein $n$ = number of electrons transferred at the anode = 4 equivalents/—mole; F = Faradays constant = 96,500 coulombs/equivalent; I = average current in amps; and $t$ = time in seconds.

We have discovered that tar formation on the cathode during the electrochemical oxidation of phenol to hydroquinone at an electrodeposited lead dioxide anode can be retarded and current efficiency maintained by the addition, either intermittently or continuously, of copper to the aqueous cell feed. The addition of copper results in the deposition, in a powdery metal form, of copper on the cathode. The metal deposit is not strongly adherent or compact and can be easily removed by brushing. The copper addition enables the cell voltage and p-benzoquinone level to be maintained at a low level and the current efficiency and chemical yield to remain at levels sufficiently high to permit cell operation for longer periods of time between cleanings. Although tar formation is substantially curtailed by the copper addition, it usually is not completely eliminated. Therefore, the use of a filter in the system, for example in a recycle loop, can prevent buildup of the minor amount of tar that is formed during prolonged periods of operation.

U.S. Pat. No. 3,616,324 describes the desirability of maintaining a high ratio of hydroquinone to p-benzoquinone in the effluent of the electrolysis cell so that processing of p-benzoquinone is minimized. Thus, another advantage afforded by our improved process is the low concentration of p-benzoquinone which must be processed during the isolation and purification of the hydroquinone product.

The copper that is added to the cell may be copper powder or certain water-soluble copper salts whose anion does not affect detrimentally the conversion of phenol to hydroquinone. Examples of useful copper salts include copper sulfate, copper carbonate, copper hydroxide, copper perchlorate, copper acetate, copper formate, copper oxalate and copper succinate, with copper sulfate being especially preferred. Copper halides and copper nitrate do not give good results in the practice of our invention.

The amount of copper that is added to the cell is determined primarily by the concentration of p-benzoquinone which, as mentioned hereinabove, is believed to be responsible for tar formation. Generally, tar formation can be reduced significantly and cathode current efficiency maintained if sufficient copper is added to maintain the concentration of p-benzoquinone in the aqueous electrolyte solution below about 0.2 weight percent, preferably below about 0.1 weight percent.

The upper limit on the amount of copper that is added will vary depending on the particular combination of process conditions that are employed. We have found that with any given combination of reaction conditions, intermittent or continuous addition of increasing amounts of copper will cause a decrease in the p-benzoquinone concentration to a point at which increased amounts of copper will not effect an appreciable decrease in p-benzoquinone concentration. Generally, this point is reached when the p-benzoquinone concentration is in the range of about 0.03 to 0.08 weight percent. The concentration of p-benzoquinone and therefore the actual amount of copper that is added, intermittently or continuously, during the electrochemical oxidation of phenol to hydroquinone can be determined by periodically sampling the cell effluent and analyzing for p-benzoquinone by polarography, liquid chromatography or UV spectroscopy.

As stated previously, the amount of copper that is required to retard tar formation and maintain cathode current efficiency is dependent on the process conditions employed. These conditions include acid concentration, concentration of phenolic compounds, current density, and temperature, some of which are interdependent. For example, the rate at which p-benzoquinone polymerizes and/or reacts with the phenolic compounds present increases as the temperature and concentrations of acid, p-benzoquinone and phenolic compounds increase. Therefore, the amount of copper required to retard tar formation will increase as the temperature and concentrations of the mentioned compounds increase. We also have discovered that when the cell flow rate is in the turbulent range, the p-benzoquinone concentration is inversely proportional to the flow rate. Consequently, the additional copper normally required by the use of relatively high temperatures and concentrations of acid, p-benzoquinone and phenolic compounds can be offset, at least in part, by using higher flow rates.

The use of copper exceeding the limits specified above can be detrimental, depending on the design of the cell that is employed. It is apparent that if the electrodes are spaced closely together, for example, 10 mm. or less, the copper may form irregular deposits on the cathode which will bridge the electrode spacing and thereby short out the cell. This bridging, of course, is dependent not only upon the amount of copper added but also upon the flow rate in the cell. If the flow rate is not sufficiently high, e.g., two to about ten ft./sec., the copper may deposit unevenly, resulting in bridging of the electrode spacing and shorting of the cell. The actual amount of copper that is required can be readily determined by those skilled in the art by practicing the process while monitoring chemical yield of hydroquinone, current efficiency, and p-benzoquinone concentration.

Upon the start-up of the electrolytic oxidation of phenol to hydroquinone in a clean cell, i.e., one in which the cathode is not coated with copper, the cathode preferably is coated with a uniform deposit of copper by adding copper to the electrolyte feed in amounts larger than are normally required to maintain cathode current efficiency over extended operating times. About 0.1 g. to 1.0 g. copper/dm$^2$ of effective cathode surface area is adequate to coat the cathode. The initial charge of a larger than normal amount of copper, although preferred, is one means for initially coating a clean cathode. The initial coating of the cathode can also be accomplished by adding excess copper, based upon previous operations under a particular combination of conditions, over an electrolysis period of a day or two until electrolysis reaches a steady state, i.e., the cell voltage and p-benzoquinone concentration are substantially constant.

The improved process of our invention can be carried out in undivided electrolytic cells of various designs. Such cell designs are described by Danly, Chapter XXVIII, Industrial Electroorganic Chemistry, p. 909–924, Organic Electrochemistry, M. M. Baizer, editor, Marcel Dekker, Inc., New York and by Tomilov et al., Brit., Chem. Eng., 16 (2/3), p. 154–159 (March, 1971): Industrial Electrolyzers for Organic Syntheses.

The solid anode having a surface of electrodeposited lead dioxide used in our novel process can be fabricated according to known techniques, e.g., as described in U.S. Pat. Nos. 2,945,791 and 3,463,707. Examples of the substrate materials on which lead dioxide may be electrodeposited include graphite, titanium, tantalum, zirconium, hafnium and columbium. The anodes used in the improved process are solid, meaning that they are essentially free of voids such as exist in mesh type anodes wherein severe arcing problems are encountered. Thus, both the substrate which is coated with lead dioxide and the resulting anode are generally solid and can be in the shape of plates, bars, rods, etc. The preferred anode is lead dioxide uniformly coated on a graphite substrate.

The cathode material of the cell can be any metal or supported metal which is stable to the electrolysis conditions described below, and on which copper will deposit under electrolysis conditions. We have found that copper and, especially, stainless steel, such as types 304 and 316, give good results. The particular cathode material which may be used in our improved process will depend, in some instances, on the configuration of the cell being used. Other cathode materials which may be used include nickel, copper-nickel alloys and noble metals such as platinum, palladium and ruthenium coated on a support such as titanium.

To achieve an acceptable rate of production, the electrochemical oxidation should be carried out under certain conditions. The concentration of phenol in the aqueous solution being electrolyzed can be in the range of about 1.0–2.5 percent by weight. However, superior results are obtained if the phenol concentration is about 1.6–2.1 percent by weight. The use of cosolvents offers no advantages and therefore the process is carried out in their absence. It is preferred not to exceed a hydroquinone-quinone concentration of about 1 to 3% by weight per volume, with a concentration in the product of about 1.5–2.5% being preferred.

A particularly important process condition is the temperature of the phenol solution being oxidized. Although temperatures in the range of about 40° to 60° C. give good results, optimum conversion rates, current efficiencies and chemical yield are realized when the oxidation is carried out at a temperature of about 45°–55° C. The flow rate of the electrolyte solution through the cell should be sufficiently high to give turbulent flow. The particular rate of flow otherwise is not critical and the choice of flow will depend on the design of the cell and the process conditions used. The pressure within the cell during electrolysis, although not particularly important, will be above atmospheric pressure as a result of maintaining a flow rate in the turbulent range.

The concentration of electrolyte in the electrolyte solution should be in the range of 3 to 10 weight percent when the electrolyte is an inorganic acid. When the electrolyte consists of a mixture of an inorganic acid and an ionizable salt, the salt concentration can range up to 10 percent by weight, or 1 to 20 percent by weight and even as high as about 30 percent by weight.

Suitable electrolytes comprise any materials which ionize readily in water at a pH of 4 or less and preferably 2 or less, and do not interfere with the phenol electrolysis. Specific examples include inorganic acids, such as sulfuric acid, perchloric acid and the like; inorganic salts such as sodium sulfate, sodium bisulfate, potassium sulfate, potassium bisulfate, lithium sulfate, lithium bisulfate, and the like with sufficient inorganic acid to maintain a pH of 4 or less.

The current density is especially important since the rate at which the phenol is oxidized by an electrolytic cell is dependent primarily upon the current passed between the electrodes. It has been found that to obtain adequate conversion rates of phenol, the current density should be at least about 20 A/dm². Due to practical considerations such as temperature control, the upper limit of the current density is about 80 A/dm². Optimum conversion of phenol to saleable products, i.e., hydroquinone and catechol, at adequately high conversion or production rates is accomplished by using a current density of about 40 to 60 A/dm².

A particularly preferred embodiment of our novel process for preparing hydroquinone comprises continuously electrolyzing an aqueous solution containing from about 1.6 to 2.1 weight to volume percent of phenol, about 5 to 8 weight percent sulfuric acid, and about 1.5 to 2.5 weight to volume percent hydroquinone and quinone, at a temperature of about 45° to 55° C., and a current density of about 40 to 60 A/cm²; and recovering hydroquinone from the aqueous solution; wherein a. the anode is graphite having a coating of electrodeposited lead dioxide and the cathode is stainless steel;

b. upon commencement of the electrolysis, copper is electrolytically deposited on the cathode surface; and c. copper is added continuously or intermittently to the aqueous solution to maintain the concentration of p-benzoquinone between about 0.01 and 0.1 weight percent.

The process described above affords a means for producing hydroquinone in good chemical yields, at high electrical efficiencies, and with excellent production rates. The addition of the copper enables electrolysis to be conducted over extended periods of time while maintaining commercially acceptable current efficiencies, chemical yields and production rates.

The novel process of the invention is further illustrated by the following examples.

EXAMPLE 1

A 0.5 inch diameter graphite rod with a rounded end is coated with lead dioxide by anodic electrodeposition to give an electrode with a surface area of 65 cm². This electrode is used with a cylindrical, type 316, stainless steel cathode in an annular arrangement giving an anode to cathode spacing of 0.3 cm. The dimensions of the cathode which contacts the electrolyte solution are 0.75 inch i.d. by 5.5 inch. The electrolytic cell is mounted in a circulation loop containing a magnetic coupled sealless polypropylene centrifugal pump, a Teflon and glass flow control valve, a gas/liquid separator, and a heat exchanger. Fresh electrolyte containing 5% sulfuric acid and 38.3 g./l. phenol is fed to the loop from a feed tank by a positive displacement metering pump at 0.512 l./hr. Effluent is taken off by overflow. The take-off rate, 0.509 l./hr., is slightly less than the feed rate due to gas generation and evaporation. The circulating loop temperature is controlled at 50° C. Loop flow rate is 2 gal./min. The loop is charged with 1 kg. of solution containing 5% sulfuric acid and 19.4 g./l. phenol. A current of 26 amperes is passed through the cell. After 22 hours the system should reach steady state. However, over the next 6 hours, the cell voltage increases from 3.68V to 3.76V and the p-benzoquinone concentration increases from 5.0 to 6.0 g./l. The interior surfaces of the circulating loop are heavily coated with a sticky black deposit. Average loop analysis for the 6 hours is 13.9 g./l. phenol, 5.8 g./l. p-benzoquinone and 12.5 g./l. hydroquinone. The current efficiency for hydroquinone plus p-benzoquinone is 35.0%. The chemical yield is 63.7%.

EXAMPLE 2

The procedure in the previous example is repeated. The feed solution containing 5% sulfuric acid, 38.8 g./l. phenol and 0.011% copper sulfate pentahydrate. The loop is charged with 1 kg. of solution containing 5% sulfuric acid and 19.1 g./l. phenol. Immediately after startup, 3.0 g. copper sulfate pentahydrate is added to the loop. The electrolyte feed rate is 0.518 l./hr. The take-off rate is 0.514 l./hr. After 23 hours the system has achieved steady state operation. The average loop analyses over the next 5.5 hours are 15.7 g./l. phenol. 0.44 g./l. p-benzoquinone and 21.1 g./l. hydroquinone. The cell voltage is a constant 3.12V. The current efficiency for hydroquinone plus p-benzoquinone is 41.4%. The chemical yield is 78.5%. The interior of the loop, including the cathode surface, remains free of tar

EXAMPLE 3

A 0.5 inch diameter graphite rod with a rounded end is coated with lead dioxide by anodic electrodeposition to give an electrode with a surface area of 65 $cm^2$. This electrode is used with a cylindrical type 304 stainless steel cathode in an annular arrangement giving an anode to cathode spacing of 0.6 cm. The electrolytic cell is mounted in a circulation loop containing a magnetic coupled sealless polypropylene centrifugal pump, a 0.2 to 3.0 gpm. rotameter, a Teflon and glass flow control valve, a gas/liquid separator and heat exchanger. Fresh electrolyte containing 3% $H_2SO_4$, 33.2 g./l. phenol, and 0.027 g./l. cupric sulfate pentahydrate is fed to the loop from the feed tank by a positive displacement metering pump at 9.94 ml./min. Effluent is taken off by overflow. The take-off rate, 9.82 ml./min., is slightly less than the feed rate due to gas generation and evaporation. The circulating loop temperature is controlled at 50° C. Loop flow rate is 1.4 gpm. The loop is charged with 980 ml. of 3% sulfuric acid solution containing 17.4 g./l. phenol and 1.4 g. cupric sulfate pentahydrate. A current of 20 amperes is passed through the cell. After 8 hr. the system reaches a steady state and samples are taken every 2 hr. for another 6 hr. The effluent contains 17.54 g./l. phenol, 12.7 g./l. hydroquinone, and 1.0 g./l. p-benzoquinone. The cell voltage is 3.79 V. The current efficiency for hydroquinone and quinone is 39.3%. The chemical yield is 72.9%.

EXAMPLE 4

An approximate 1.8% phenol/3.0% sulfuric acid solution is oxidized at 30A/$dm^2$ of anode surface and 50° C. in two annular cells composed of lead dioxide on graphite anodes and stainless steel cathodes with 6.5-mm spacing. The solution being oxidized is continuously recycled through two loops containing a cell, heat exchanger, degasser, pump, and filter at a flow velocity of about 4.7 ft./sec. The hold-up time in the two loop reactor is about 1.6 hr. Initially about 1.2 g. of copper sulfate pentahydrate is added per $dm^2$ of cathode surface. Copper sulfate is then added to the feed at such a rate that the p-benzoquinone concentration is maintained at about 0.03%. The overall hydroquinone yield for 32 days of operation is 69.1%; the overall current efficiency is 38.8%. The average cell coltage is 4.3 V. The hydroquinone in the product solution averages about 2.0%.

EXAMPLE 5

The procedure in Example 3 is repeated at 61.5A/$dm^2$ and 8% sulfuric acid. The feed solution contains 8% sulfuric acid, 42.62 g./l. phenol, and 0.010% copper sulfate pentahydrate. The loop is charged with 1.0 kg of solution containing 8% sulfuric acid and 20.05 g./l. phenol. A current of 40 A is passed through the cell. Immediately after startup, 3.0 g. copper sulfate pentahydrate is added to the loop. The electrolyte feed rate of 0.794 l./hour. The take-off rate is 0.788 l./hour. After 6 hours, the system reaches steady state. Average loop analyses for the next 95 hours are 17.85 g./l. phenol, 20.27 g./l. hydroquinone, and 0.71 g./l. p-benzoquinone. The cell voltage gradually decreases from 3.15V to 3.08V during the run. The current efficiency for hydroquinone and quinone is 40.2% and the chemical yield is 71.4%. There is some tar buildup in the gas/liquid separator, but the circulation loop remains fairly clean.

EXAMPLE 6

The procedure of Example 3 is repeated at 52 A/$dm^2$ and 6.7% sulfuric acid. The feed solution contains 42.72 g./1. phenol, 6.7% sulfuric acid and 0.015% copper sulfate pentahydrate. The loop is charged with 1 kg. of solution containing 6.7% sulfuric acid and 20.66 g./l. phenol. A current of 34 amperes is passed through the cell. Immediately after startup, 3.0 g. copper sulfate pentahydrate is added to the loop. The electrolyte feed rate is 0.762 l./hour. The take-off rate is 0.757 l./hour. After 23 hours, the system reaches steady state. Average loop analyses for the next 6 hours are 18.77 g./l. phenol, 19.71 g./l. hydroquinone, and 0.74 g./l. p-benzoquinone. The cell voltage is 3.14V. The current efficiency for hydroquinone plus quinone is 44.3% and the chemical yield is 72.1%. The circulation loop remains clean.

Although the invention has been described in considerable detail with particular reference to certain preferred embodiments thereof, variations and modifications can be effected within the spirit and scope of the invention.

We claim:

1. Process for the preparation of hydroquinone which comprises electrolyzing an aqueous solution containing about 1.0 to 3.0 weight percent phenol, about 3 to 10 weight percent sulfuric acid and about 1.0 to 3.0 weight to volume percent hydroquinone and p-benzoquinone at a temperature of about 40° to 60° C. and a current density of about 20 to 80 A/$dm^2$, in a cell comprising a solid anode having a coating of electrodeposited lead dioxide, and a copper or stainless steel cathode, wherein the p-benzoquinone concentration in the aqueous solution is maintained below about 0.2 weight percent by the addition of copper to the cell.

2. Process according to claim 1 wherein the anode is graphite having a coating of electrodeposited lead dioxide.

3. Process according to claim 1 wherein the anode is titanium having a coating of electrodeposited lead dioxide.

4. Process for the preparation of hydroquinone which comprises electrolyzing an aqueous solution containing about 1.6 to 2.1 weight to volume percent phenol, about 5 to 8 weight percent sulfuric acid, and about 1.5 to 2.5 weight to volume percent hydroquinone at a temperature of about 45° to 55° C. and a current density of about 40 to 60 A/$cm^2$ in a cell comprising a solid anode of graphite having a coating of electrodeposited lead dioxide and a stainless steel cathode having a coating of copper powder, wherein copper sulfate is added to the cell in an amount sufficient to maintain the p-benzoquinone concentration in the range of about 0.03 to 0.1 weight percent.

* * * * *